US012440028B2

(12) United States Patent
Zhang et al.

(10) Patent No.: US 12,440,028 B2
(45) Date of Patent: Oct. 14, 2025

(54) QUICK-ASSEMBLY STRUCTURE FOR CHASSIS AND SEAT CUSHION OF CHAIR

(71) Applicant: SUNON TECHNOLOGY CO.,LTD, Zhejiang (CN)

(72) Inventors: Xujun Zhang, Zhejiang (CN); Hao Wu, Zhejiang (CN); Changjiang Liu, Zhejiang (CN); Xianping He, Zhejiang (CN); Aijun Qian, Zhejiang (CN); Xiubing Du, Zhejiang (CN)

(73) Assignee: SUNON TECHNOLOGY CO., LTD, Zhejiang (CN)

( * ) Notice: Subject to any disclaimer, the term of this patent is extended or adjusted under 35 U.S.C. 154(b) by 299 days.

(21) Appl. No.: 18/451,779

(22) Filed: Aug. 17, 2023

(65) Prior Publication Data

US 2024/0099466 A1 Mar. 28, 2024

(30) Foreign Application Priority Data

Sep. 28, 2022 (CN) ..... 202222575717.1

(51) Int. Cl.
*A47C 4/02* (2006.01)
*A47C 7/00* (2006.01)

(52) U.S. Cl.
CPC ..... *A47C 4/02* (2013.01); *A47C 7/004* (2013.01)

(58) Field of Classification Search
CPC ..... A47C 4/02; A47C 7/004
See application file for complete search history.

(56) References Cited

U.S. PATENT DOCUMENTS 6,231,126 B1 * 5/2001 Cheng ..... A47C 7/004 297/344.21
8,857,912 B2 * 10/2014 Feltrin ..... A47C 4/03 297/440.22
8,882,201 B2 * 11/2014 Gorza ..... A47C 4/03 297/440.22
9,462,889 B2 * 10/2016 Piretti ..... A47C 1/03255
10,155,455 B1 * 12/2018 Lin ..... B60N 2/933
(Continued)

FOREIGN PATENT DOCUMENTS

CN 110179273 A * 8/2019 ..... A47C 3/026
CN 115227058 A * 10/2022 ..... A47C 7/004
(Continued)

*Primary Examiner* — Timothy J Brindley
(74) *Attorney, Agent, or Firm* — JCIPRNET

(57) ABSTRACT

A quick-assembly structure includes first inserting connection structures, where each of the first inserting connection structures includes an inserting and clamping member and a groove body; each of the groove bodies includes an inserting groove and a clamping groove which are in communication with each other, the corresponding inserting and clamping member is inserted into the inserting groove in a vertical direction and then horizontally slides into the clamping groove in a first direction; and the seat cushion is further provided with elastic buckles, the chassis includes a clamping connection surface, and when the inserting and clamping members slide to predetermined positions in the clamping grooves, the elastic buckles are clamped with the clamping connection surface of the chassis in an abutting manner so as to restrict the chassis from sliding relative to the seat cushion in a direction opposite to the first direction.

10 Claims, 3 Drawing Sheets

(56) References Cited

U.S. PATENT DOCUMENTS

| | | | | |
|---|---|---|---|---|
| 10,772,434 | B2 * | 9/2020 | Susie | A47C 7/546 |
| 11,202,509 | B2 * | 12/2021 | Yajima | A47C 7/14 |
| 2014/0239687 | A1 * | 8/2014 | Hazzard | A47C 4/02 297/440.22 |
| 2025/0235001 | A1 * | 7/2025 | Guo | A47C 3/30 |

FOREIGN PATENT DOCUMENTS

| | | | | |
|---|---|---|---|---|
| KR | 101446461 | B1 * | 10/2014 | A47C 1/03294 |
| KR | 102010183 | B1 * | 8/2019 | A47C 5/04 |
| WO | WO-2004073458 | A1 * | 9/2004 | A47D 1/08 |

* cited by examiner

QUICK-ASSEMBLY STRUCTURE FOR CHASSIS AND SEAT CUSHION OF CHAIR

CROSS-REFERENCE TO RELATED APPLICATION

This application claims the priority benefit of China application serial no. 202222575717.1, filed on Sep. 28, 2022. The entirety of the above-mentioned patent applications is hereby incorporated by reference herein and made a part of this specification.

TECHNICAL FIELD

The present disclosure relates to the technical field of chairs, in particular to a quick-assembly structure for a chassis and a seat cushion of a chair.

BACKGROUND

Generally, a seat of an existing office chair mainly comprises a chassis and a seat cushion, and the seat cushion is located at an upper portion of the chassis. In order to facilitate packaging of the chair, the existing seat cushion and chassis of the chair are generally designed in a split manner so as to facilitate separate packaging, and a user can assemble the seat cushion and the chassis after receiving the chair.

At present, the chassis and the seat cushion of the chair are mainly assembled by fitting screws with holes. By means of such screw connection manner, although the chassis and the seat cushion can be assembled, the assembly operation is relatively strenuous and is not easy enough, and the phenomena of deviations of the holes or slippage of the screws appear easily, which may result in the situation that assembly cannot be performed. Therefore, there is room for improvement.

SUMMARY OF THE INVENTION

In order to solve at least one technical problem mentioned in the background, the present disclosure provides a quick-assembly structure for a chassis and a seat cushion of a chair.

To achieve the above-mentioned purposes, the present disclosure provides the following technical solution:

the quick-assembly structure for a chassis and a seat cushion of a chair comprises first inserting connection structures, wherein each of the first inserting connection structures comprises an inserting and clamping member and a groove body adapted to be in inserting fit with the inserting and clamping member, one of the inserting and clamping member and the groove body is provided on a chassis, and the other one is provided on a seat cushion; each of the groove bodies comprises an inserting groove and a clamping groove which are in communication with each other, the corresponding inserting and clamping member is inserted into the inserting groove in a vertical direction and then horizontally slides into the clamping groove in a first direction, and when the inserting and clamping member is located in the clamping groove, the seat cushion and the chassis are kept positioned relative to each other in the vertical direction; and the seat cushion is further provided with elastic buckles, the chassis comprises a clamping connection surface, and when the inserting and clamping members slide to predetermined positions in the clamping grooves, the elastic buckles are clamped with the clamping connection surface of the chassis in an abutting manner so as to restrict the chassis from sliding relative to the seat cushion in a direction opposite to the first direction.

Compared with the prior art, the solution has the advantages as follows:

in the solution, the seat cushion and the chassis are assembled in an inserting fit manner instead of a traditional screw manner, and compared with the screw assembly manner, the inserting fit manner has the benefits as follows:

firstly, the seat cushion and the chassis are not required to be connected by means of screws during an assembly process, thereby avoiding the problem of slippage of the screws or deviations of screw holes;

secondly, the chassis and the seat cushion are more convenient and quicker to assemble, specifically, during assembly, all that is required is to firstly align the inserting and clamping members to the inserting grooves and then vertically insert the inserting and clamping members into the inserting grooves, then the inserting and clamping members are slid horizontally in the first direction to be clamped into the clamping grooves, and at this time, the seat cushion and the chassis are positioned relative to each other in the vertical direction, that is, the two cannot be separated in the vertical direction; and in addition, in the solution, the elastic buckles are also provided, so that after the inserting and clamping members are clamped into the clamping grooves, the elastic buckles can match the clamping connection surface of the chassis to limit the chassis, the chassis cannot slide relative to the seat cushion in the direction opposite to the first direction, the inserting and clamping members are limited indirectly, the inserting and clamping members cannot slide back into the inserting grooves from the clamping grooves, and the chassis and the seat cushion are kept in a relatively positioned state in the first direction.

In conclusion, in the solution, the seat cushion and the chassis can be assembled relatively conveniently and quickly under the joint action of the first inserting connection structures and the elastic buckles.

Preferably, the quick-assembly structure further comprises second inserting connection structures for keeping the seat cushion and the chassis positioned relative to each other in the vertical direction, wherein the first inserting connection structures and the second inserting connection structures are arranged in a spaced manner in the first direction.

Preferably, each of the second inserting connection structures comprises an inserting block and an inserting connection groove allowing the inserting block to be inserted in the first direction, one of the inserting block and the inserting connection groove is provided on the chassis, and the other one is provided on the seat cushion; and when the inserting and clamping members slide to the predetermined positions in the clamping grooves, the inserting blocks are inserted into the inserting connection grooves.

Preferably, the width of the clamping grooves is less than that of the inserting grooves, and the inserting grooves and the clamping grooves are sequentially formed in a spaced manner in the first direction; each of the inserting and clamping members comprises a sliding-in portion extending in the vertical direction and capable of sliding in the corresponding inserting groove, and an end portion of the sliding-in portion extends towards a peripheral side to form a clamping portion; and the width of the clamping portions is greater than that of the clamping grooves.

Preferably, a space allowing each of the elastic buckles to be deformed is provided between the elastic buckle and a bottom surface of the seat cushion.

Preferably, a rear end surface of the chassis in the first direction constitutes the clamping connection surface.

Preferably, the quick-assembly structure comprises at least two first inserting connection structures and/or at least two second inserting connection structures, wherein the at least two first inserting connection structures and/or the at least two second inserting connection structures are respectively located on two sides of the chassis.

Preferably, sides of the chassis are provided with lateral sliding plates extending in the first direction, in the first direction, the inserting blocks are formed at front ends of the lateral sliding plates, and the inserting and clamping members are arranged at rear ends of the lateral sliding plates.

Preferably, the inserting connection grooves are provided in the seat cushion, guide plates are arranged at the bottom of the seat cushion, and the guide plates and a bottom wall of the seat cushion are arranged in a spaced manner to form the inserting connection grooves.

Preferably, a bottom wall of a rear end of each of the guide plates is inclined to form an inclined guide surface.

Other advantages and effects of the present disclosure are illustrated in detail in the detailed description of the embodiments.

DETAILED DESCRIPTION OF THE EMBODIMENTS

The technical solutions in embodiments of the present disclosure will be described clearly and completely below. Obviously, the described embodiments are only part of embodiments of the present disclosure, not all of them. On the basis of the embodiments of the present disclosure, all other embodiments obtained by those of ordinary skill in the art without involving any inventive effort should fall within the scope of protection of the present disclosure.

Embodiment

Figure 1:
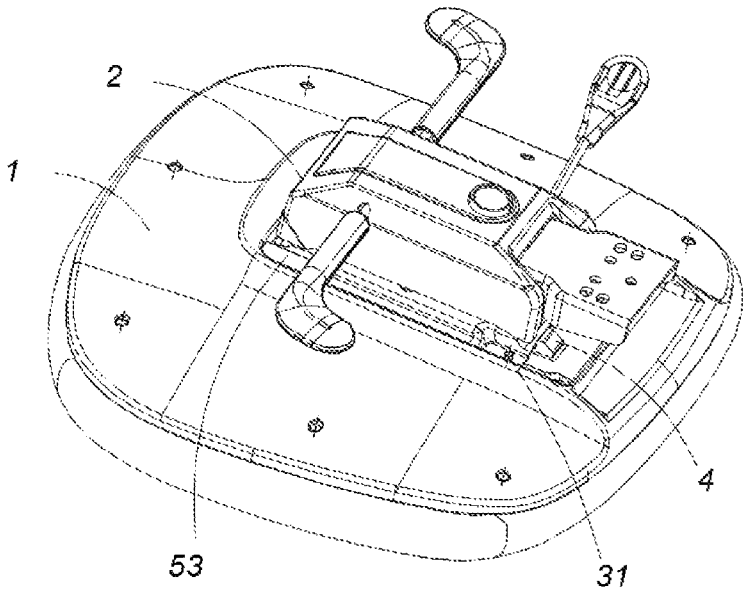
FIG. 1 is a structure diagram of a seat cushion and a chassis in an assembled state.

To facilitate understanding, a seat of a chair is simply introduced firstly before this embodiment is specifically illustrated. As shown in FIG. 1, the seat mainly comprises a chassis 2 and a seat cushion 1, in an assembled state, the seat cushion 1 is located at the top of the chassis 2 to be supported by the chassis 2. A quick-assembly structure provided in this embodiment is mainly configured to quickly assemble the chassis 2 and the seat cushion 1 of the chair, and is specifically illustrated below.

Reference is made to FIGS. 1-5, and this embodiment provides the quick-assembly structure for the chassis 2 and the seat cushion 1 of the chair. In view of FIG. 2, the quick-assembly structure comprises first inserting connection structures 3, wherein each of the first inserting connection structures 3 comprises an inserting and clamping member 31 and a groove body adapted to be in inserting fit with the inserting and clamping member 31, one of the inserting and clamping member 31 and the groove body is provided on the chassis 2, and the other one is provided on the seat cushion 1; and in view of FIGS. 2 and 4, this embodiment specifically shows that the inserting and clamping members 31 are provided on the chassis 2 and the groove bodies are formed in the seat cushion 1.

Figure 3:
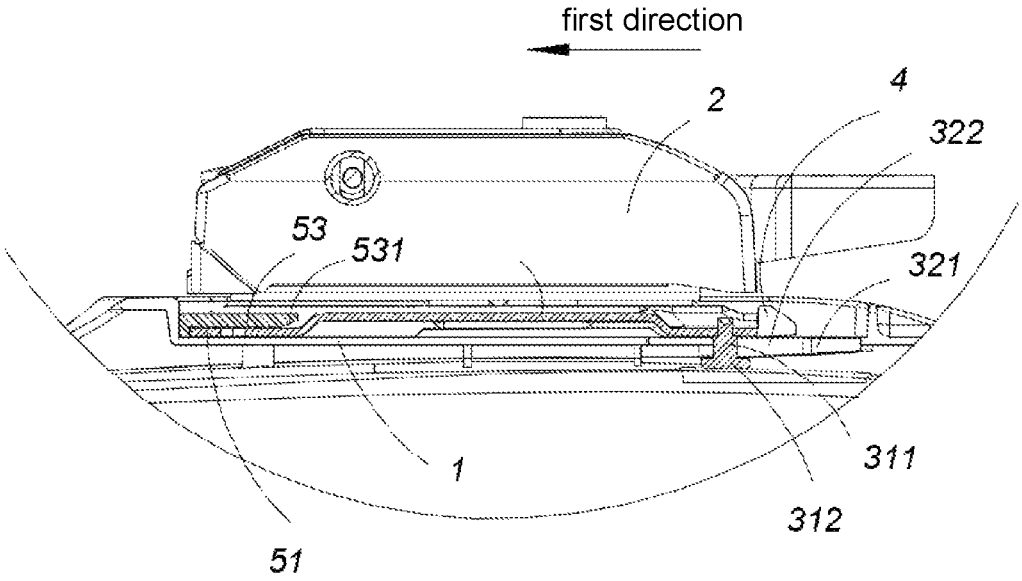
FIG. 3 is a sectional view of the seat cushion and the chassis in the assembled state.
Figure 5:
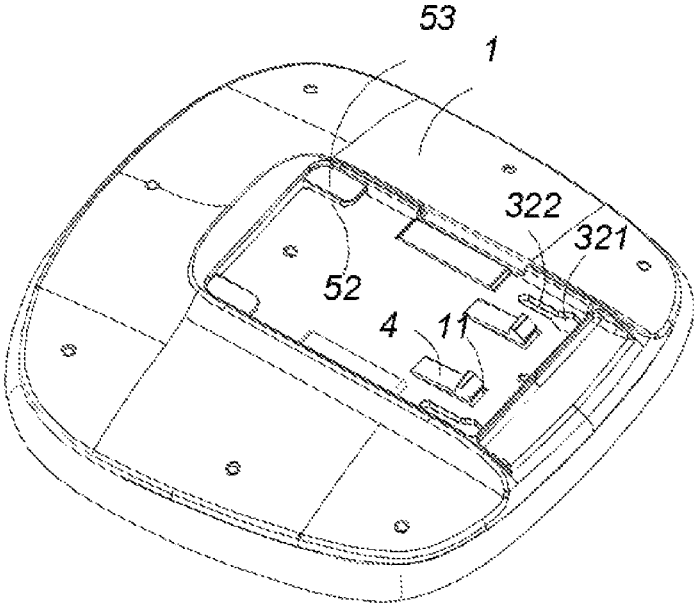
FIG. 5 is a structure diagram of the seat cushion.

As shown in FIG. 5, each of the groove bodies comprises an inserting groove 321 and a clamping groove 322 which are in communication with each other, and in this embodiment, both the inserting groove 321 and the clamping groove 322 are formed in the bottom of the seat cushion 1; the corresponding inserting and clamping member 31 is inserted into the inserting groove 321 in a vertical direction and then horizontally slides into the clamping groove 322 in a first direction; and in a viewing angle as shown in FIG. 3, the first direction in this embodiment can also be understood as a horizontal leftward direction, and the vertical direction is perpendicular to the first direction.

In a state as shown in FIG. 3, when the inserting and clamping members 31 are located in the clamping grooves 322, the seat cushion 1 and the chassis 2 are kept positioned relative to each other in the vertical direction. In other words, the inserting and clamping members 31 and the clamping grooves 322 form clamping structures, so that the inserting and clamping members 31 cannot be pulled out of the clamping grooves 322 in the vertical direction, and the seat cushion 1 and the chassis 2 are positioned relative to each other in the vertical direction.

Figure 4:
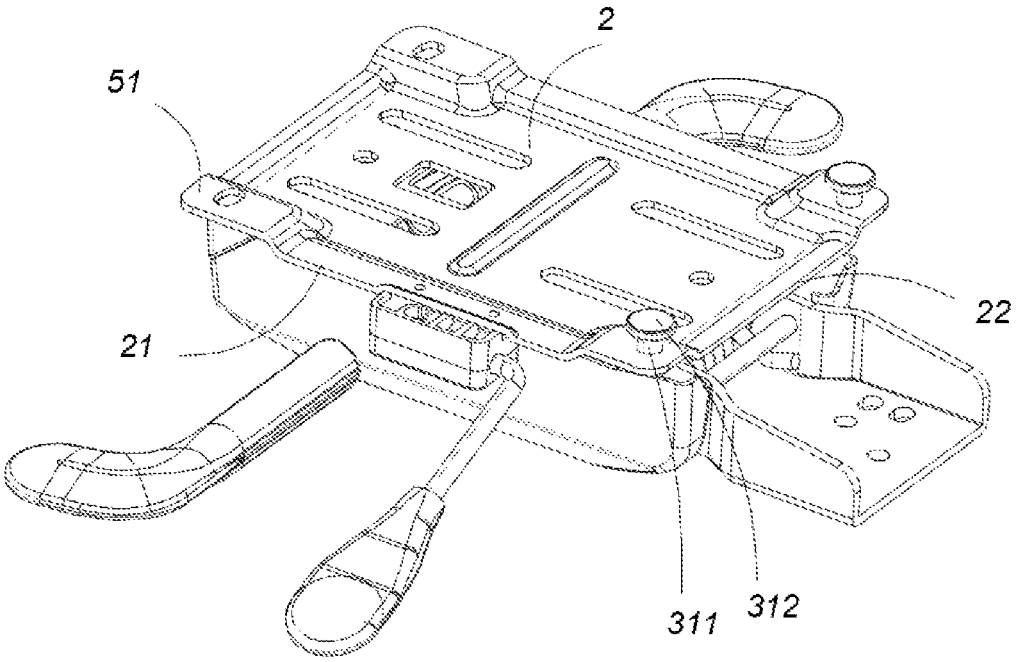
FIG. 4 is a structure diagram of the chassis.

As shown in FIGS. 4 and 5, the seat cushion 1 is further provided with elastic buckles 4, the chassis 2 comprises a clamping connection surface 22, and when the inserting and clamping members 31 slide to predetermined positions in the clamping grooves 322, the elastic buckles 4 are clamped with the clamping connection surface 22 of the chassis 2 in an abutting manner so as to restrict the chassis 2 from sliding relative to the seat cushion 1 in a direction opposite to the first direction. In the viewing angle as shown in FIG. 3, the direction opposite to the first direction here can be understood as a horizontal rightward direction.

During assembly, all that is required is to firstly align the inserting and clamping members 31 to the inserting grooves 321 and then vertically insert the inserting and clamping members 31 into the inserting grooves 321, then the inserting and clamping members 31 are slid horizontally in the first direction to be clamped into the clamping grooves 322, and at this time, the seat cushion 1 and the chassis 2 are positioned relative to each other in the vertical direction, that is, the two cannot be separated in the vertical direction.

Thus, when the inserting and clamping members 31 are inserted to the predetermined positions, which are preferably end walls of the ends of the clamping grooves 322 away from the inserting grooves 321 in this embodiment, in the clamping grooves 322, that is, when the inserting and clamping members 31 abut against the end walls of the clamping grooves 322, the elastic buckles 4 will be bounced to be clamped on the clamping connection surface 22 of the chassis 2 to limit the chassis 2 in the state as shown in FIG. 3, the chassis 2 cannot slide relative to the seat cushion 1 in the direction opposite to the first direction, the inserting and clamping members 31 are limited indirectly, the inserting and clamping members 31 cannot slide back into the inserting grooves 321 from the clamping grooves 322, and the chassis 2 and the seat cushion 1 are kept in a relatively positioned state in the first direction.

The clamping connection surface 22 is specifically formed as follows: as shown in FIG. 4, a rear end surface of the chassis 2 in the first direction constitutes the clamping connection surface 22. Thus, in the assembled state, the elastic buckles 4 will be clamped on the rear end surface of the chassis 2, buckled portions of the elastic buckles 4 will be exposed outside, a user can press the elastic buckles 4 to remove the clamped state of the elastic buckles 4 and the clamping connection surface 22, and then the chassis 2 can slide out relative to the seat cushion 1 in the direction opposite to the first direction, thereby disassembling the seat cushion 1 from the chassis 2.

Of course, to enable the elastic buckles 4 to be capable of being pressed normally to remove the clamped state, a space allowing each of the elastic buckles 4 to be deformed is provided between the elastic buckle 4 and a bottom surface of the seat cushion 1, specifically, as shown in FIG. 5, avoiding grooves 11 are formed in the positions of a bottom wall of the seat cushion corresponding to the elastic buckles 4, and the elastic buckles 4 can be pressed into the avoiding grooves 11 to perform actions for removing the clamped state.

Figure 2:
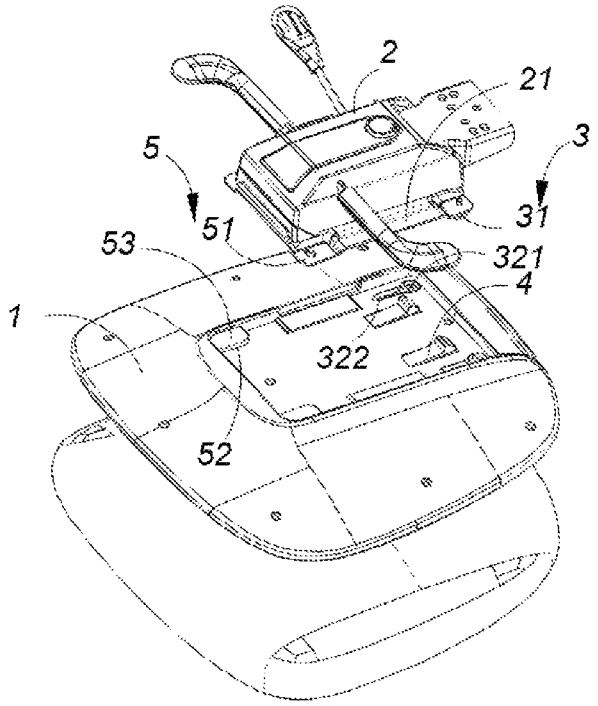
FIG. 2 is a split view of the seat cushion and the chassis.

To assemble the seat cushion 1 and the chassis 2 more stably, in this embodiment, as shown in FIG. 2, the quick-assembly structure further comprises second inserting connection structures 5 for keeping the seat cushion 1 and the chassis 2 positioned relative to each other in the vertical direction, wherein the first inserting connection structures 3 and the second inserting connection structures 5 are arranged in a spaced manner in the first direction. Thus, after the seat cushion and the chassis 2 are assembled, in the first direction, each of the first inserting connection structures 3 can form a clamping point at a rear portion of the chassis 2, the corresponding second inserting connection structure 5 can form the other clamping point at a front portion of the chassis 2, the chassis 2 and the seat cushion 1 can be positioned relative to each other in the vertical direction by means of the two clamping points, and the seat cushion 1 and the chassis 2 are more stable after being assembled.

The specific structure of each of the second inserting connection structures 5 is as follows: as shown in FIGS. 4 and 5, the second inserting connection structure 5 comprises an inserting block 51 and an inserting connection groove 52 allowing the inserting block 51 to be inserted in the first direction, one of the inserting block 51 and the inserting connection groove 52 is provided on the chassis 2, and the other one is provided on the seat cushion 1; and this embodiment specifically shows that the inserting connection groove 52 is provided at the bottom of the seat cushion 1 and the inserting block 51 is provided on the chassis 2.

As shown in FIG. 3, when the inserting and clamping members 31 slide to the predetermined positions in the clamping grooves 322, the inserting blocks 51 are inserted into the inserting connection grooves 52, at this time, the inserting blocks 51 and the inserting connection grooves 52 are kept positioned relative to each other in the vertical direction, and then the chassis 2 and the seat cushion 1 are kept positioned relative to each other in the vertical direction.

It is understandable that the first inserting connection structures 3 and the second inserting connection structures 5 are arranged in the spaced manner in the first direction, so that when the inserting and clamping members 31 slide in the clamping grooves 322 in the first direction, the inserting blocks 51 will also slide into the inserting connection grooves 52 in the first direction at the same time, thereby achieving the inserting fit of the inserting connection grooves 52 and the inserting blocks 51.

The specific composition of the inserting connection grooves 52 is as follows: guide plates 53 are arranged at the bottom of the seat cushion 1, the guide plates 53 are arranged horizontally, the guide plates 53 and the bottom wall of the seat cushion 1 are arranged in a spaced manner to form the inserting connection grooves 52, the inserting connection grooves 52 extend in the first direction, and the inserting blocks 51 being inserted into the inserting connection grooves 52 is equivalent to the inserting blocks 51 being inserted into the positions between the guide plates 53 and the bottom wall of the seat cushion 1.

In order to enable each of the inserting blocks 51 to be relatively smoothly inserted into the corresponding inserting connection groove 52, in this embodiment, as shown in FIG. 3, a bottom wall of a rear end of each of the guide plates 53 is inclined to form an inclined guide surface 531, thus a groove opening of the inserting connection groove 52 tends to be gradually narrowed in the first direction, and the inserting block can be better inserted into the inserting connection groove 52.

In order to further improve the stability of the seat cushion 1 and the chassis 2 after assembly, in this embodiment, the quick-assembly structure comprises at least two first inserting connection structures 3 and/or at least two second inserting connection structures 5, wherein the at least two first inserting connection structures 3 and/or the at least two second inserting connection structures 5 are respectively located on two sides of the chassis 2.

This embodiment specifically shows that, as shown in FIGS. 4 and 5, the quick-assembly structure comprises two first inserting connection structures 3 symmetrically arranged on the two sides of the chassis 2 and two second inserting connection structures 5 symmetrically arranged on the two sides of the chassis 2; thus, positioning can be realized on the two sides of the chassis 2 and two sides of the seat cushion 1 at the same time, which can improve the stability of the assembled state of the chassis and the seat cushion.

Specifically, as shown in FIG. 4, the two sides of the chassis 2 are provided with lateral sliding plates 21 extending in the first direction, in the first direction, the inserting blocks 51 are formed at front ends (equivalent to left ends in FIG. 3) of the lateral sliding plates 21, and the inserting and clamping members 31 are arranged at rear ends (equivalent to right ends in FIG. 3) of the lateral sliding plates 21.

The specific composition of the inserting and clamping members 31 and the groove bodies is as follows: as shown in FIG. 5, the width of the clamping grooves 322 is less than that of the inserting grooves 321, and the inserting grooves 321 and the clamping grooves 322 are sequentially formed in a space manner in the first direction, thereby ensuring that the inserting and clamping members 31 can slide into the clamping grooves 322 in the first direction after being inserted into the inserting grooves 321.

As shown in FIG. 4, each of the inserting and clamping members 31 comprises a sliding-in portion 311 extending in the vertical direction and capable of sliding in the corresponding inserting groove 321, and an end portion of the sliding-in portion 311 extends towards a peripheral side to form a clamping portion 312; the width of the clamping portions 312 is greater than that of the clamping grooves 322; and the size of the inserting grooves 321 is configured to allow the clamping portions 312 to be vertically inserted, and when the sliding-in portions 311 slide into the clamping grooves 322, the clamping portions 312 are hooked and clamped at the bottoms of the clamping grooves 322 to relatively position the seat cushion 1 and the chassis 2 in the vertical direction.

As shown in FIG. 4, preferably, the inserting and clamping members 31 are of cylindrical structures having T-shaped axial sections, specifically, the inserting and clamping members can be of bolt structures, and cap ends of bolts constitute the clamping portions 312.

What is claimed is:

1. A quick-assembly structure for a chassis and a seat cushion of a chair, the quick-assembly structure comprising first inserting connection structures, wherein each of the first inserting connection structures comprises an inserting and clamping member and a groove body adapted to be in inserting fit with the inserting and clamping member, one of the inserting and clamping member and the groove body is provided on the chassis, and the other one is provided on the seat cushion; each of the groove bodies comprises an inserting groove and a clamping groove which are in communication with each other, the corresponding inserting and clamping member is inserted into the inserting groove in a vertical direction and then horizontally slides into the clamping groove in a first direction, and when the inserting and clamping member is located in the clamping groove, the seat cushion and the chassis are kept positioned relative to each other in the vertical direction; and the seat cushion is further provided with elastic buckles, the chassis comprises a clamping connection surface, and when the inserting and clamping members slide to predetermined positions in the clamping grooves, the elastic buckles are clamped with the clamping connection surface of the chassis in an abutting manner so as to restrict the chassis from sliding relative to the seat cushion in a direction opposite to the first direction.

2. The quick-assembly structure according to claim 1, further comprising second inserting connection structures for keeping the seat cushion and the chassis positioned relative to each other in the vertical direction, wherein the first inserting connection structures and the second inserting connection structures are arranged in a spaced manner in the first direction.

3. The quick-assembly structure according to claim 2, wherein each of the second inserting connection structures comprises an inserting block and an inserting connection groove allowing the inserting block to be inserted in the first direction, one of the inserting block and the inserting connection groove is provided on the chassis, and the other one is provided on the seat cushion; and when the inserting and clamping members slide to the predetermined positions in the clamping grooves, the inserting blocks are inserted into the inserting connection grooves.

4. The quick-assembly structure according to claim 1, wherein a width of the clamping grooves is less than a width of the inserting grooves, and the inserting grooves and the clamping grooves are sequentially formed in a spaced manner in the first direction; each of the inserting and clamping members comprises a sliding-in portion extending in the vertical direction and capable of sliding in the corresponding inserting groove, and an end portion of the sliding-in portion extends towards a peripheral side to form a clamping portion; and a width of the clamping portions is greater than the width of the clamping grooves.

5. The quick-assembly structure according to claim 1, wherein a space allowing each of the elastic buckles to be deformed is provided between the elastic buckle and a bottom surface of the seat cushion.

6. The quick-assembly structure according to claim 5, wherein a rear end surface of the chassis in the first direction constitutes the clamping connection surface.

7. The quick-assembly structure according to claim 2, comprising at least two first inserting connection structures and/or at least two second inserting connection structures, wherein the at least two first inserting connection structures and/or the at least two second inserting connection structures are respectively located on two sides of the chassis.

8. The quick-assembly structure according to claim 3, wherein sides of the chassis are provided with lateral sliding plates extending in the first direction, in the first direction, the inserting blocks are formed at front ends of the lateral sliding plates, and the inserting and clamping members are arranged at rear ends of the lateral sliding plates.

9. The quick-assembly structure according to claim 3, wherein the inserting connection grooves are provided in the seat cushion, guide plates are arranged at a bottom of the seat cushion, and the guide plates and a bottom wall of the seat cushion are arranged in a spaced manner to form the inserting connection grooves.

10. The quick-assembly structure according to claim 9, wherein a bottom wall of a rear end of each of the guide plates is inclined to form an inclined guide surface.

* * * * *